US012509748B2

(12) United States Patent
Chen

(10) Patent No.: US 12,509,748 B2
(45) Date of Patent: Dec. 30, 2025

(54) ALUMINUM ALLOY WITH ULTRA-HIGH THERMAL CONDUCTIVITY AND MANUFACTURING METHOD THEREOF

(71) Applicant: CHARNG CHYI ALUMINUM CO., LTD., Tainan (TW)

(72) Inventor: Sheng-I Chen, Tainan (TW)

(73) Assignee: CHARNG CHYI ALUMINUM CO., LTD., Tainan (TW)

( * ) Notice: Subject to any disclaimer, the term of this patent is extended or adjusted under 35 U.S.C. 154(b) by 393 days.

(21) Appl. No.: 18/314,118

(22) Filed: May 8, 2023

(65) Prior Publication Data

US 2024/0376571 A1 Nov. 14, 2024

(51) Int. Cl.

| | |
|---|---|
| ***C22C 21/00*** | (2006.01) |
| ***C22C 1/02*** | (2006.01) |
| *B22D 7/00* | (2006.01) |

(52) U.S. Cl.

CPC ..... *C22C 21/00* (2013.01); *C22C 1/026* (2013.01); *B22D 7/005* (2013.01)

(58) Field of Classification Search

CPC ..... C22C 21/00

See application file for complete search history.

(56) References Cited

PUBLICATIONS

CN 102220524 A machine translation and original document (Year: 2011).*

CN 102220524 A. Google machine translation with "Similar Documents". 6 pages. (Year: 2011).*

* cited by examiner

*Primary Examiner* — Tima M. McGuthry-Banks

(57) ABSTRACT

This invention provides aluminum alloy with ultra-high thermal conductivity, wherein the weight percentage of the composition: nickel: 2~5%, carbon: 0.1~0.5%, titanium: 0.01~0.2%, iron: <0.1%, silicon: <0.1%, the metal components including copper, zinc, manganese, magnesium, chromium, lead, and tin is respectively <0.01%, M is another element with a content being limited to less than 0.005%, and the balance is aluminum; wherein the steps of the manufacturing method: a crucible furnace heated up to 500° C. or higher; adding pure aluminum ingots to smelt, refining and deslagging at 720° C., adding the nickel and stirring at temperature range between 750~810° C., sampling and analyzing the composition after melting is completed and confirmed, confirming whether the melting is completely after adding aluminum titanium carbon and stirring; degassing through a rotary degassing device; letting stand for 10 minutes; sampling and determining the composition, and casting aluminum ingots.

2 Claims, 4 Drawing Sheets

ALUMINUM ALLOY WITH ULTRA-HIGH THERMAL CONDUCTIVITY AND MANUFACTURING METHOD THEREOF

BACKGROUND OF THE PRESENT INVENTION

Field of Invention

The present invention relates to an aluminum alloy with ultra-high thermal conductivity and manufacturing method thereof, in particular to an industrial aluminum alloy manufacturing field.

Description of Related Arts

The mainly raw material of Aluminum alloy ingots is pure aluminum and recycled aluminum. The other elements are added in accordance with international standards or special requirements, such as: silicon (Si), magnesium (Mg), iron (Fe), etc., to improve alloys formulated with pure aluminum with insufficient castability, chemical properties and physical properties generally used in the foundry industry.

With the rapid development of science and technology, performance and precision requirements of equipment are getting higher and higher. Harsh operating environment requirements are demanded for precision equipment, and temperature control is an important part of ensuring equipment operation. Temperature control of most equipment is closely related to heat sink, but in order to improve the heat dissipation performance of heat sink, in addition to structural changes, the most fundamental thing is to improve the heat dissipation performance of the material used to prepare the heat sink. Therefore, it is necessary to develop a more reasonable preparation method capable of preparing high-quality heat-dissipating materials that can be formed and processed to meet the requirements of equipment configured with higher heat generation, and provide a guarantee for improving the integration degree and reducing the size of various devices. However, in actual production, the currently available aluminum alloy materials have poor heat conduction performance.

SUMMARY OF THE PRESENT INVENTION

A main object of the present invention is to provide aluminum alloy with ultra-high thermal conductivity and manufacturing method thereof, which can be used in aluminum alloy products made of parts that require ultra-high thermal conductivity, and can meet the thermal conductivity requirements of particular industries for aluminum alloy materials.

The composition of the aluminum alloy with ultra-high thermal conductivity of the present invention is mainly composed of aluminum, nickel, and aluminum titanium carbon, and the weight percentages of the composition are as follows: nickel is 2~5%, carbon of aluminum titanium carbon is 0.1%~0.5%, titanium of aluminum titanium carbon is 0.01~0.2%, iron is less than 0.1%, silicon is less than 0.1%, the metal components including copper, zinc, manganese, magnesium, chromium, lead, and tin is respectively less than 0.01%, M is another element with a content being limited to less than 0.005%, and the balance is aluminum.

The composition of the aluminum alloy with ultra-high thermal conductivity of the present invention, the weight percentage of aluminum is greater than 94%.

The manufacturing method of the aluminum alloy with ultra-high thermal conductivity of the present invention comprises the steps of:

- a crucible furnace being preheated up to 500° C. or higher;
- adding in pure aluminum ingots to smelt;
- refining and deslagging when the temperature of the molten aluminum reaches 720° C.;
- adding nickel to melt when the temperature raised to 750° C., and the smelting temperature is controlled at 750~810° C. after completion of the refining and the deslagging;
- sampling and analyzing the composition after confirming that the nickel is melted completely after fully stirring;
- adding aluminum titanium carbon after the nickel composition being confirmed; stirring and confirming that the melting of aluminum titanium carbon is completed;
- degassing through a rotary degassing device, wherein the degassing process takes about 5 to 10 minutes;
- letting stand for about 10 minutes after completion of degassing completed;
- sampling and determining the composition, wherein the final composition determination must meet the prescribed conditions; and
- casting aluminum ingots.

The aluminum alloy with ultra-high thermal conductivity and manufacturing method thereof of the present invention, advantages include the following: the aluminum alloy with ultra-high thermal conductivity of the present invention has both high temperature strength and conductivity, creating an aluminum alloy that is easy to form and process, and without heat treatment, the thermal conductivity of the aluminum alloy is similar to that of pure aluminum, which can be up to more than 230 W/mK, with very excellent heat dissipation effect, and can be applied to aluminum alloy die casting, aluminum alloy casting and other production methods, the products of the aluminum alloy can be applied to electronic parts with high heat dissipation and heat conduction requirements, such as computers, communications, consumer electronics devices, 5G network equipment, automotive electronic parts, motor rotors, aerospace/satellite communications and so on.

DETAILED DESCRIPTION OF THE PREFERRED EMBODIMENT

Regarding the technical means adopted by the invention to achieve the above-mentioned object and efficacies, a preferred and feasible embodiment is explained in details hereunder in conjunction with the figures.

Figure 1:
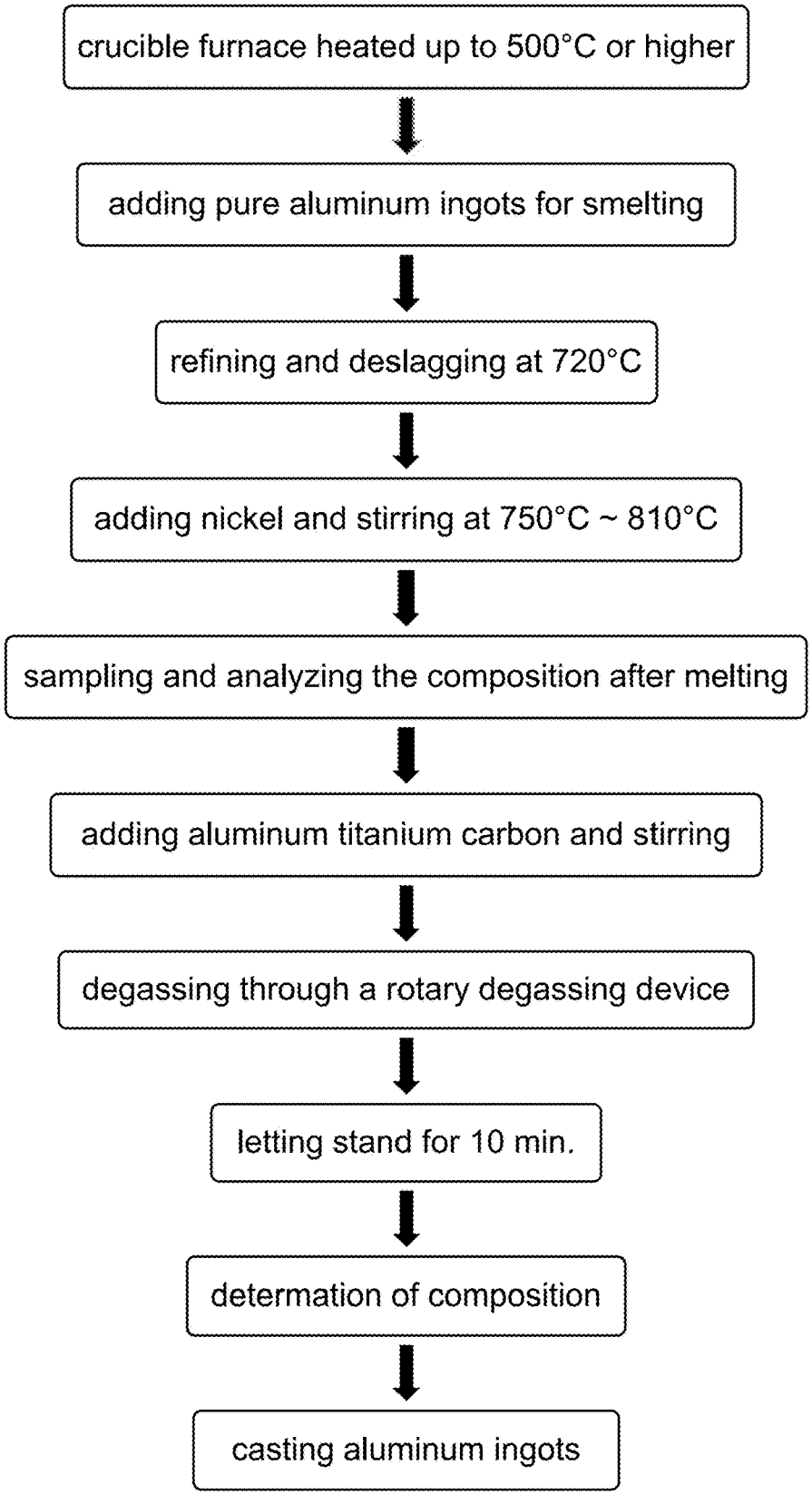
FIG. 1 is a flow chart of a preparation method of one embodiment of the present invention.

The manufacturing method of the aluminum alloy with ultra-high thermal conductivity of the present invention, referring to FIG. 1, the method comprises steps of:

a crucible furnace being preheated up to 500° C. or higher;

adding in pure aluminum (Al) ingots to smelt;

refining and deslagging when the temperature of the molten aluminum reaches 720° C.;

adding nickel (Ni) to melt when the temperature raised to 750° C., and the smelting temperature is controlled at 750~810° C., after completion of refining and deslagging;

sampling and analyzing the composition after confirming that the nickel is melted completely after fully stirring;

adding aluminum titanium carbon (AlTiC) after the nickel composition being confirmed; stirring and confirming that the melting of aluminum titanium carbon is completed;

degassing through a rotary degassing device, wherein the degassing process takes about 5 to 10 minutes;

letting stand for about 10 minutes after completion of degassing;

sampling and determining the composition, wherein the final composition determination must meet the prescribed conditions (as shown in Table 1); and casting aluminum ingots.

TABLE 1

| unit weight % | | | | |
|---|---|---|---|---|
| Iron (Fe) | Nickel (Ni) | Silicon (Si) | Titanium (Ti) | Aluminum (Al) |
| 0.1max | 2~5 max | 0.1 max | 0.01~0.2 | 94 min |

The composition of the aluminum alloy with ultra-high thermal conductivity of the present invention is mainly composed of aluminum (Al), nickel (Ni), and aluminum titanium carbon (AlTiC), wherein the weight percentages of the composition is as follows: nickel is 2~5%, carbon (C) of aluminum titanium carbon is 0.1%~0.5%, titanium (Ti) is 0.01~0.2%, iron (Fe) is less than 0.1%, silicon (Si) is less than 0.1%, the metal components including copper, zinc, manganese, magnesium, chromium, lead, and tin is respectively <0.01, M is another element with a content being limited to less than 0.005%, and the balance aluminum (Al) is greater than 94%.

Figure 2:
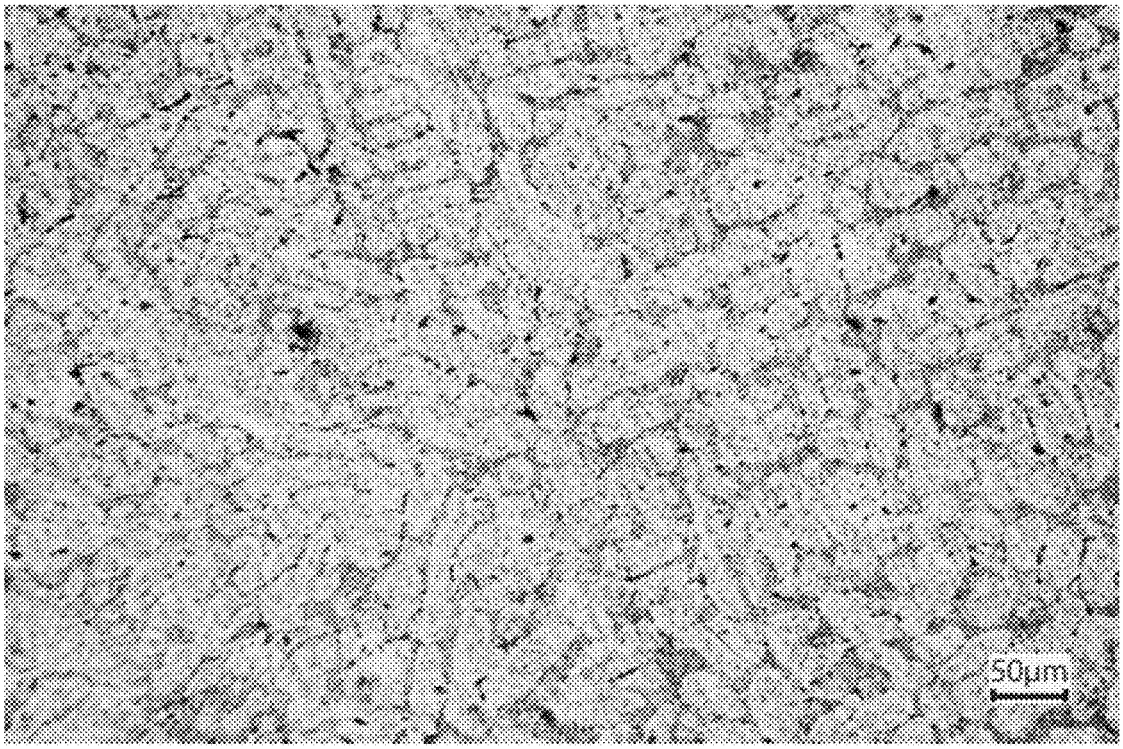
FIG. 2 is the metallographic microstructure diagram of the aluminum alloy with 2.5% nickel added of the present invention.
Figure 3:
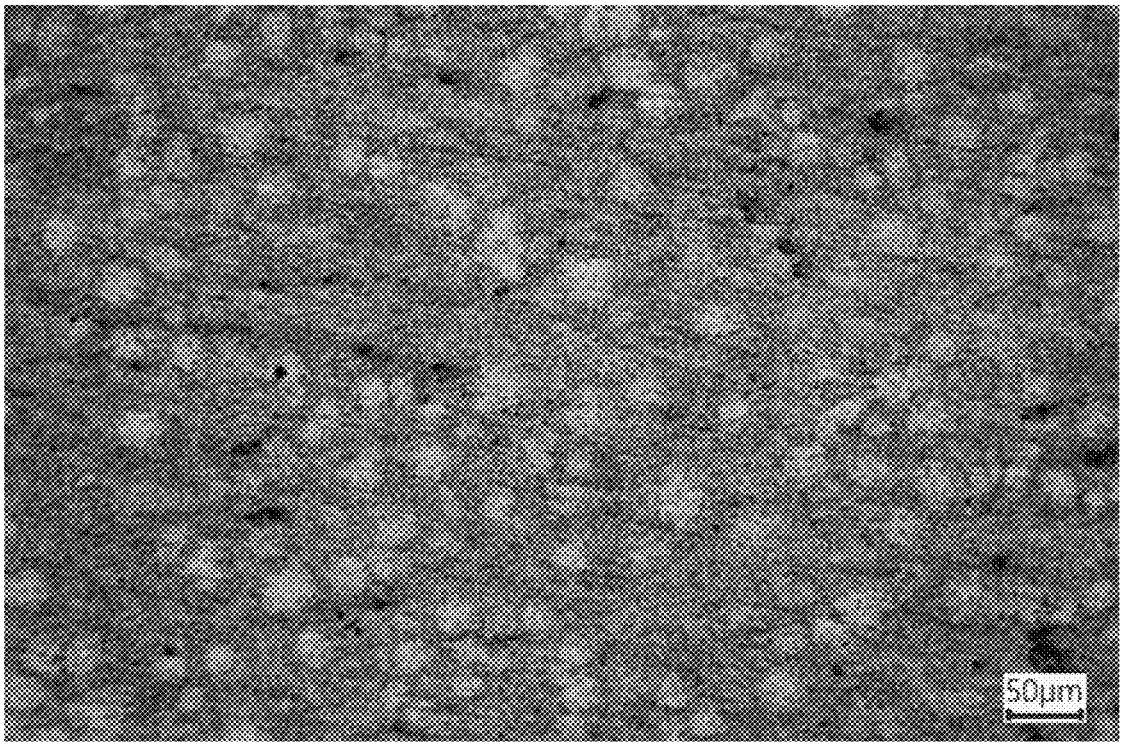
FIG. 3 is the metallographic microstructure diagram of the aluminum alloy with 2.5% nickel and aluminum titanium carbon added of the present invention.
Figure 4:
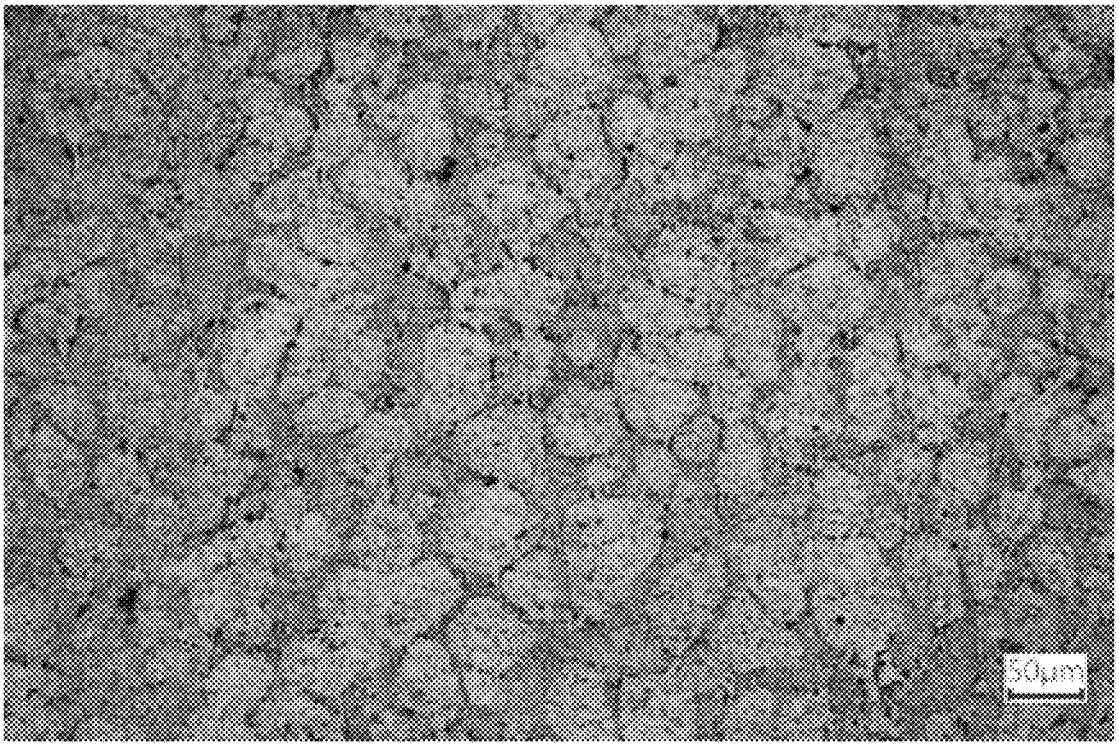
FIG. 4 is the metallographic microstructure diagram of the aluminum alloy with 3.3% nickel and aluminum titanium carbon added of the present invention.
Figure 5:
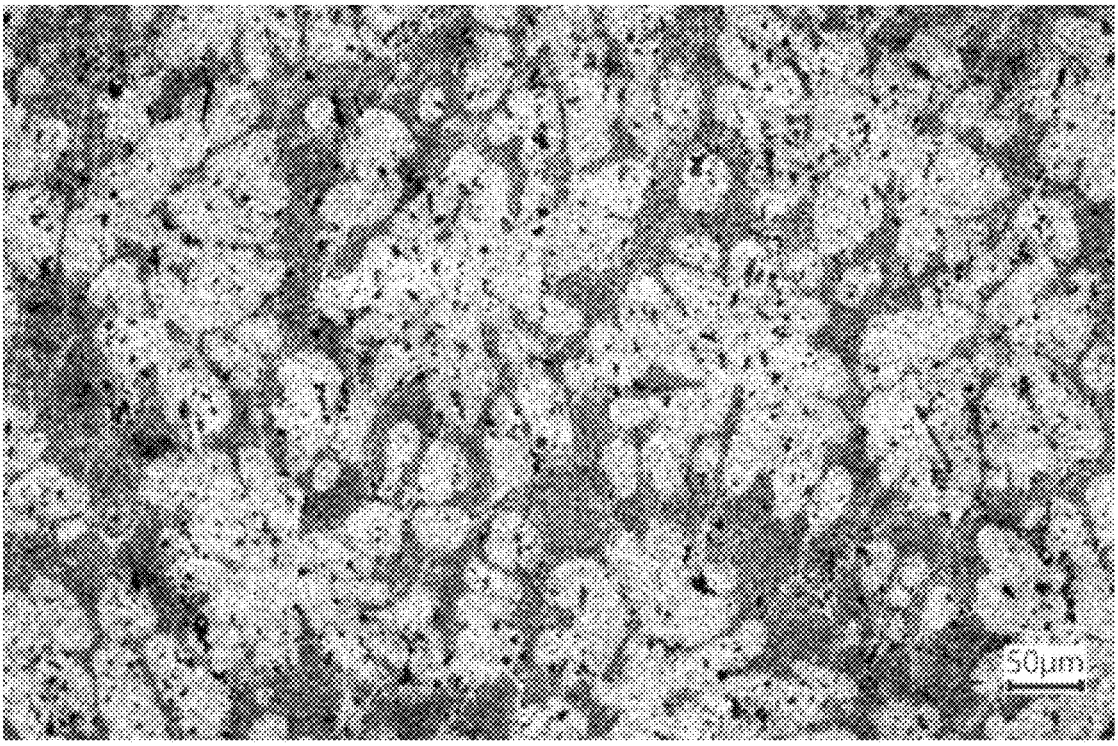
FIG. 5 is the metallographic microstructure diagram of the aluminum alloy with 3.5% nickel and aluminum titanium carbon added of the present invention.
Figure 6:
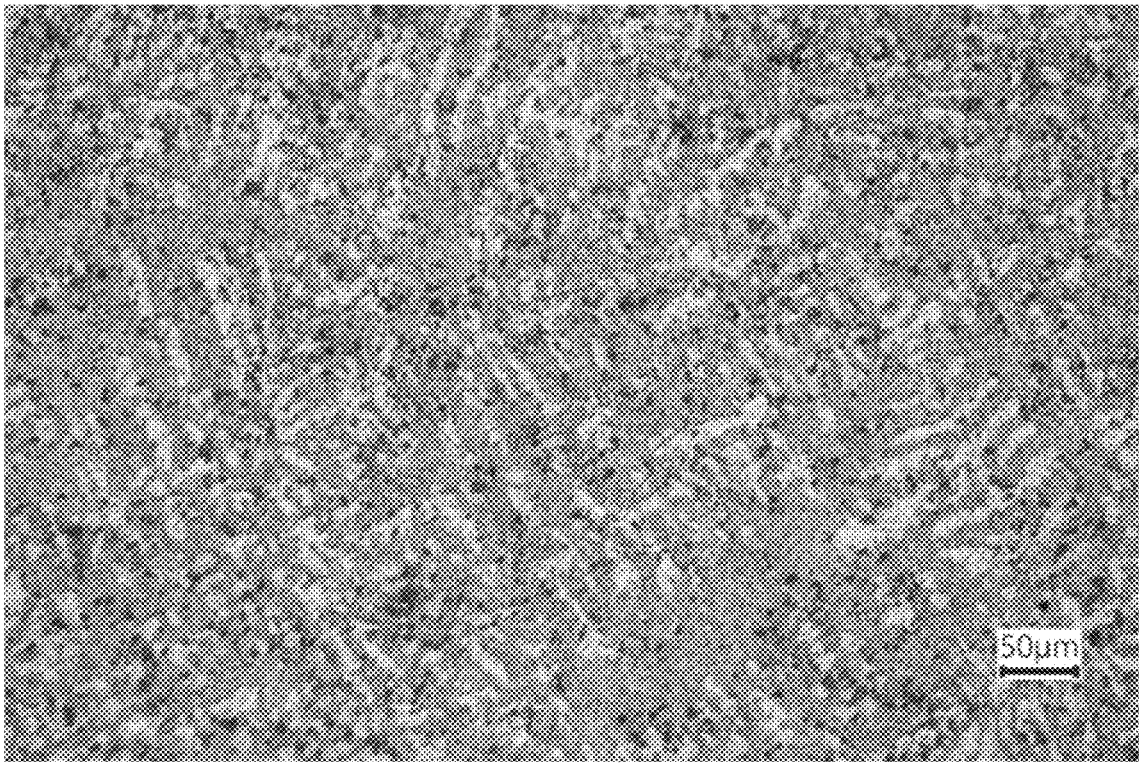
FIG. 6 is the metallographic microstructure diagram of the aluminum alloy with 5% nickel added of the present invention.

In the present invention, the metallographic structure formed by adding different proportions of nickel and aluminum titanium carbon to the aluminum alloy is not the same. FIG. 2 is the metallographic microstructure diagram of the present invention with the addition of 2.5% nickel examined through a microscope. FIG. 3 is the metallographic microstructure diagram of the present invention with the addition of 2.5% nickel and aluminum titanium carbon through the microscope. FIG. 4 is the metallographic microstructure diagram of the present invention with the addition of 3.3% nickel and aluminum titanium carbon examined through the microscope. FIG. 5 is the metallographic microstructure diagram of the present invention with the addition of 3.5% nickel and aluminum titanium carbon examined through the microscope. FIG. 6 is a metallographic microstructure view of the present invention with the addition of 5% nickel examined through the microscope.

The aluminum alloy made according to the different additions of nickel (Ni) according to the present invention, wherein the thermal conductivity and tensile test results of the aluminum alloy are shown in Table 2:

TABLE 2

| | thermal | tensile test | | |
|---|---|---|---|---|
| Specification | conductivity (W/Mk) | yield strength (MPa) | tensile strength (MPa) | elongation rate (%) |
| Ni 5% | 243.1 | 54 | 121 | 30 |
| Ni 2.5% | 236.6 | 41 | 102 | 37 |
| Ni 3.3% | | 46 | 113 | 39 |
| Ni 3.5% | | 46 | 111 | 38 |

The aluminum alloy with ultra-high thermal conductivity of the present invention has electrical conductivity and is close to the thermal conductivity of pure aluminum, which is beneficial to aluminum alloy die-casting/aluminum alloy casting molding, and the cast product is easy to process.

In summary, the invention has indeed achieved the intended object and efficacy of use, and is more ideal and practical than the prior art. However, the above-mentioned embodiment is merely the specific description of the preferred embodiment of the invention, the embodiment is not intended to limit the claims of the invention, and all other equivalent changes and modifications completed without departing from the technical means disclosed in the invention should be included in the claims covered by the invention.

What is claimed is:

1. Aluminum alloy with ultra-high thermal conductivity consisting essentially of aluminum, nickel, and aluminum-titanium carbon, wherein the weight percentages of the composition is as follows: nickel is 2~5%, carbon is 0.1~0.5%, titanium is 0.01~0.2%, iron is less than 0.1%, silicon is less than 0.1%, the metal components including copper, zinc, manganese, magnesium, chromium, lead, and tin is less than 0.01%, M is another element with a content being limited to less than 0.005%, and the balance is aluminum (Al).

2. The aluminum alloy with ultra-high thermal conductivity, as recited in claim 1, wherein the weight percentage of aluminum is greater than 94%.

* * * * *